US008375859B2

(12) United States Patent
Sagebiel

(10) Patent No.: US 8,375,859 B2
(45) Date of Patent: Feb. 19, 2013

(54) SHAPED EXPLOSIVE CHARGE

(75) Inventor: Erick J. Sagebiel, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 196 days.

(21) Appl. No.: 12/730,879

(22) Filed: Mar. 24, 2010

(65) Prior Publication Data

US 2011/0232519 A1 Sep. 29, 2011

(51) Int. Cl.
*F42B 12/10* (2006.01)
*F42B 12/14* (2006.01)

(52) U.S. Cl. ..... 102/476; 102/306; 102/309

(58) Field of Classification Search ..... 102/306, 102/307, 308, 309, 476
See application file for complete search history.

(56) References Cited

U.S. PATENT DOCUMENTS

| | | | | | |
|---|---|---|---|---|---|
| 2,407,093 | A * | 9/1946 | Mohaupt | 83/53 |
| 2,513,233 | A * | 6/1950 | Byers | 102/306 |
| 2,757,611 | A * | 8/1956 | Church et al. | 102/307 |
| 2,856,850 | A * | 10/1958 | Church et al. | 102/307 |
| 3,906,857 | A * | 9/1975 | Rotondi, Jr. | 102/428 |
| 3,934,511 | A | 1/1976 | Cordle et al. | |
| 4,466,353 | A * | 8/1984 | Grace | 102/307 |
| 4,513,666 | A | 4/1985 | Segletes | |
| 5,078,069 | A * | 1/1992 | August et al. | 114/20.1 |
| H1216 | H | 8/1993 | Vigil et al. | |
| 5,320,044 | A * | 6/1994 | Walters | 102/475 |
| 6,443,068 | B1 * | 9/2002 | Meister | 102/308 |
| 6,477,959 | B1 * | 11/2002 | Ritman et al. | 102/476 |
| 6,644,205 | B2 * | 11/2003 | Ritman et al. | 102/476 |
| 6,668,726 | B2 | 12/2003 | Lussier | |
| 6,758,143 | B2 * | 7/2004 | Ritman et al. | 102/476 |
| 6,840,178 | B2 * | 1/2005 | Collins et al. | 102/476 |
| 6,925,924 | B2 | 8/2005 | Baker et al. | |
| 7,621,221 | B2 * | 11/2009 | Ritman | 102/475 |
| 7,819,064 | B2 * | 10/2010 | Saenger et al. | 102/310 |
| 2003/0177933 | A1 * | 9/2003 | Fortner et al. | 102/476 |
| 2010/0212532 | A1 * | 8/2010 | Reinmuller | 102/476 |

* cited by examiner

*Primary Examiner* — James Bergin
(74) *Attorney, Agent, or Firm* — Grossman, Tucker et al

(57) ABSTRACT

A shaped charge explosive device is provided having a front, a rear and an axis of symmetry with the device comprising an explosive charge, a liner lining a front of the explosive charge, the liner having a recess in the form of a groove encircling the axis of symmetry; and the groove arranged to provide an axis of projection for the liner at an angle A relative to the axis of symmetry. A method of cutting a structure is provided comprising the steps of providing the foregoing device, detonating the explosive charge to create a detonation wave; forming the liner into an formed projectile in the shape of an annular ring with the detonation wave; directing the formed projectile towards the structure; and forming an annular ring cut pattern in the structure with the formed projectile.

24 Claims, 5 Drawing Sheets

SHAPED EXPLOSIVE CHARGE

FIELD OF THE INVENTION

The present invention relates to an explosive device having a shaped explosive charge to form a projectile. More particularly, the present invention relates to an explosive device comprising an annular shaped linear shaped charge to form an elongated explosively formed annular ring shaped projectile, which may be used as a cutting tool to form an annular ring shaped cut pattern in a structure.

BACKGROUND

A shaped charge may be understood to be a device having an explosive charge shaped to focus the effect of an explosive's energy. The shaped charge may be of a shape having a cavity therein, which is opposite the initiation train. If the cavity does not contain a liner, such may be referred to as an unlined shaped charge. Alternatively, if the cavity does contain a liner, such may be referred to as a lined shaped charge.

Conventional lined shaped charges are constructed with a charge casing, a hollow conical liner within the case, and the explosive charge positioned between the liner and case. A detonator is activated to initiate the explosive material to generate a detonation wave. This wave collapses and compresses the liner to form a high velocity jet and a slower moving slug as known to the art. The jet properties depend on the charge shape, the energy released, the liner mass and the liner composition.

U.S. Statutory Invention Registration No. H1216 in the name of Vigil et al., which published Aug. 3, 1993, discloses a linear shaped charge with rectangular shape. Due to the oblong configuration thereof, such may not be well suited for applications such as a warhead, which may better have a cylindrical configuration to better facilitate use with rockets, missiles, torpedoes and other self-propelled bombs.

U.S. Patent Application Publication No. 2006/0075888 in the name of Yang et al., which published Apr. 13, 2006, discloses a radial linear shaped charge pipe cutter. Thus, the jet disclosed therein appears to travel radially rather than axially, and does not appear capable of forming an annular ring shaped cut pattern.

While the above appear to contribute to the art of explosive devices, there is still a need for improvement. It is an object of the present invention to improve upon the art of explosive devices by providing an annular shaped linear shaped charge to form an elongated explosively formed annular ring shaped projectile, which may be used as a cutting tool to form an annular ring shaped cut pattern in a structure.

SUMMARY

According to one object of the invention, a shaped charge device may be provided comprising an explosive charge, a liner lining a front of the explosive charge with the liner having a recess in the form of a groove encircling an axis of symmetry and the groove arranged to provide an axis of projection for the liner at an angle B relative to the axis of symmetry. In certain embodiments, the angle B may be in the range of and all increments between 1 degree to 45 degrees with the axis of projection diverging along the axis of symmetry from a rear of the device towards a front of the device.

The groove may be V-shaped and circular or polygonal, and may have an apex angle A in the range of and all increments between 20 degrees to 140 degrees. The groove may be defined by an outer wall portion of the liner and an inner portion of the liner relative to the axis of symmetry, with the outer wall portion of the liner converging along the axis of symmetry from the front of the device towards the rear of the device while the inner wall portion diverges along the axis of symmetry from the front of the device towards the rear of the device. The outer wall portion and the inner wall portion may both be frusto-conical and planar.

The liner may have a circular or polygonal periphery and the groove may extend to the circular or polygonal periphery of the liner. The liner may be comprised of metal. The explosive charge may be arranged to form the liner into a formed projectile in the shape of an annular ring upon a detonation thereof. The annular ring may be circular or polygonal.

The explosive charge may comprise a high explosive, which may be characterized as a material that detonates, meaning that the explosive shock front passes though the material at a supersonic speed (e.g. 3,000 to 9,000 meters/second). The high explosive charge may comprise an organic nitrate explosive, such as a nitramine explosive.

The shaped charge explosive device may further comprise a core plug, which may be encircled by the explosive charge, as well as a detonator, which may include a ring of detonators or an explosive shaped detonation train, and casing, which may be circular or polygonal, located to a rear of the explosive charge. The casing and the liner may be in the form of an enclosed tubular channel.

According to another object of the invention, a method of cutting a structure may be provided comprising the steps of providing a shaped charge device comprising an explosive charge, a liner lining a front of the explosive charge, the liner having a recess in the form of a groove encircling an axis of symmetry and the groove arranged to provide an axis of projection for the liner at an angle B relative to the axis of symmetry; detonating the explosive charge to create a detonation wave; forming the liner into an formed projectile in the shape of an annular ring with the detonation wave; directing the formed projectile towards the structure; and forming an annular ring cut pattern in the structure with the formed projectile. The formed projectile may be in the shape of an annular jet ring or slug ring. The annular ring cut pattern may be conical or a polygonal pyramid.

The method may further comprise the shaped charge explosive device having a core plug, and impacting a portion of the structure within the annular ring cut pattern with the core plug.

The structure may be targeted by a weapon containing the shaped charge explosive device. The weapon may comprise a rocket, missile, torpedo or other self-propelled bomb. The weapon may comprise a warhead and the structure may comprise a structure of an enclosure.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
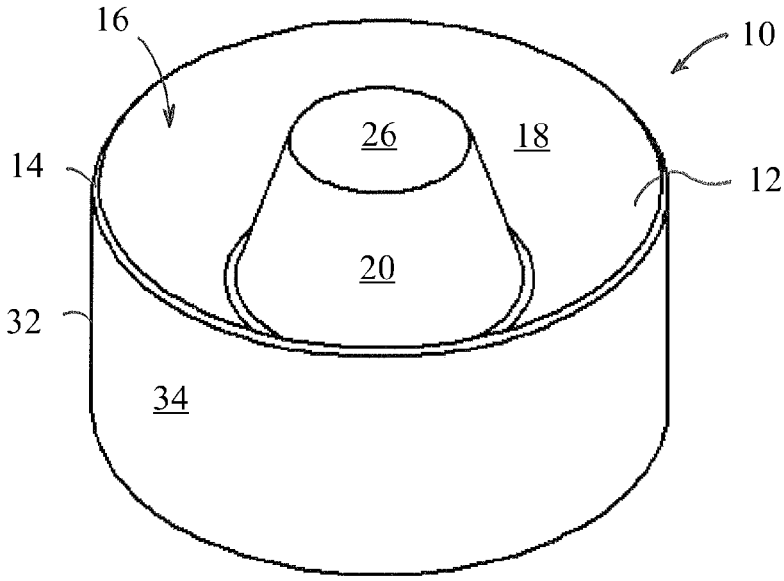
FIG. 1 is a perspective view of a shaped charge explosive device according to one embodiment of the present invention.

It may be appreciated that the present disclosure is not limited in its application to the details of construction and the arrangement of components set forth in the following description or illustrated in the drawings. The embodiments herein may be capable of other embodiments and of being practiced or of being carried out in various ways. Also, it may be appreciated that the phraseology and terminology used herein is for the purpose of description and should not be regarded as limiting as such may be understood by one of skill in the art.

Figure 2:
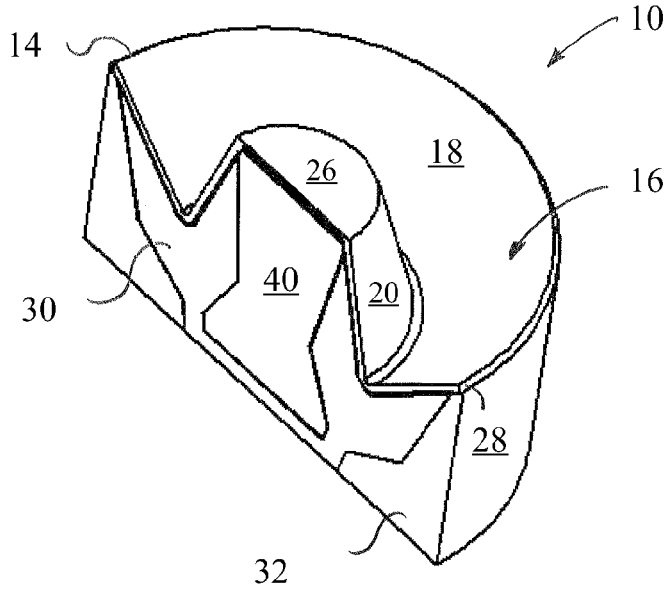
FIG. 2 is a cross-sectional perspective view of the shaped charge explosive device of FIG. 1 taken along line 2-2.

Referring to FIGS. 1 and 2, a lined shaped charge explosive device is shown at reference character 10. Explosive device 10 comprises a seamless circular liner 12. Liner 12 may comprise materials such as metal, glass, ceramic or other suitable material. More particularly, metal liners may comprise aluminum, beryllium, cadmium, cobalt, copper, gold, lead, magnesium, molybdenum, nickel, platinum, silver, tantalum, tin, titanium, tungsten, depleted uranium, zinc and zirconium. Liner 12 may have a thickness in the range of and all increments between 0.5 millimeters to 12 millimeters, and more particularly in the range of and all increments between 2 millimeters to 6 millimeters. However, the thickness will depend on the overall scale.

Figure 5:
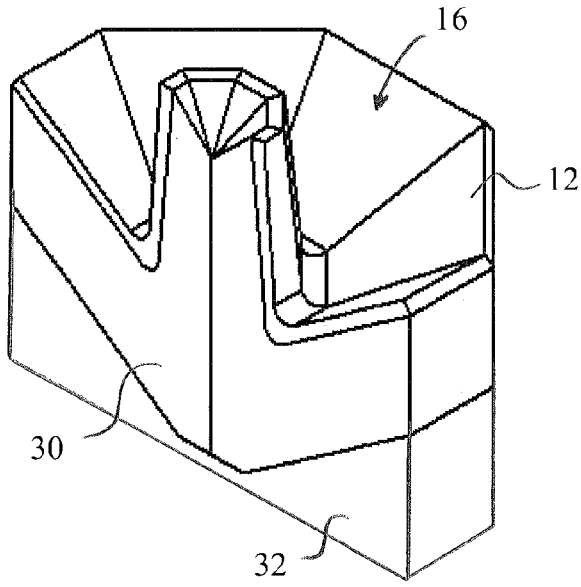
FIG. 5 is a cross-sectional perspective view of a shaped charge explosive device according to another embodiment of the present invention.

Liner 12 has a circular indentation or recess in the form of a V-shaped circular groove 16 which encircles axis of symmetry 22 and may surround disc portion 26, which can aid in the formation of a jet and slug as described below. However, in alternative embodiments, such as shown in FIG. 5, disc portion 26 may be eliminated.

Figure 3:
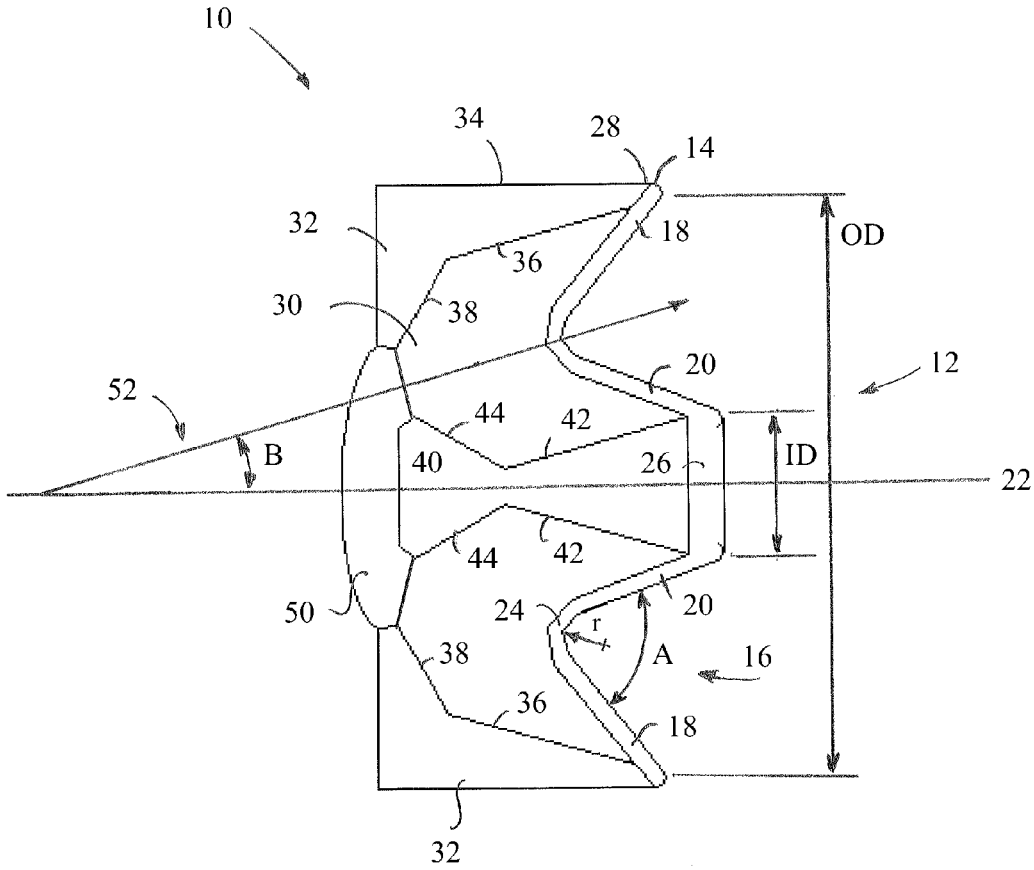
FIG. 3 is a cross-sectional side view of the shaped charge explosive device of FIG. 1 taken along line 2-2.

Groove 16 has adjacent planar frusto-conical wall portions 18, 20 with front side surfaces which form a concave apex angle A as shown in FIG. 3. Concave angle A may be in the range of and all increments between 20 degrees to 140 degrees, more particularly in the range of and all increments between 30 degrees to 110 degrees, and even more particularly in the range of and all increments between 30 degrees to 90 degrees.

Liner 12 has a circular periphery 14 which overlies an adjacent edge 28 of casing 32 described in further detail below. For purposes of orientation herein, liner 12 is located to a front of device 10 while casing 32 is located to a rear of device 10.

From circular periphery 14, to form circular groove 18, outer frusto-conical wall portion 18 may converge rearwardly relative to axis of symmetry 22 while inner frusto-conical wall portion 20 may diverge rearwardly relative to axis of symmetry 22. With respect to one another, wall portions 18 and 20 converge rearwardly towards the apex 24 of groove 16. As shown, the wall portions 18, 20 of liner 12 do not necessarily form an acute sharp angle at the apex 24 of angle A but rather are formed with a radius r in the range of and all increments between 1 millimeter to 8 millimeters. However, in alternative embodiments it should be recognized that wall portions 18, 20 may form a sharp angle.

At the mouth or opening of groove 16, which is opposite apex 24, outer frusto-conical wall portion 18 may terminate in a maximum outer diameter OD, which may define the circular periphery of 34 of liner 12, in the range of and all increments between 25 millimeters to 300 millimeters, and more particularly in the range of and all increments between 50 millimeters to 150 millimeters. Also at the entrance to groove 16, inner frusto-conical wall portion 20 may terminate in a minimum inner diameter ID in the range of and all increments between 5 millimeters to 250 millimeters, and more particularly in the range of and all increments between 20 millimeters to 100 millimeters.

Beneath liner 12 is located an annular ring shaped explosive charge 30, which is located between liner 12 and casing 32. Explosive charge 30 may comprise a high explosive, which may be characterized as a material that detonates, meaning that the explosive shock front passes though the material at a supersonic speed (e.g. 3,000 to 9,000 meters/second). The high explosive charge may comprise an organic nitrate explosive, such as a nitramine explosive. The explosive charge may also comprise nitroaromatics (e.g. 2,4,6-trinitrotoluene; 1,3,5-trinitrobenzene; 2,4-dinitrotoluene; 2,6-dinitrotoluene).

More particularly, the explosive charge 30 may comprise 1,3,5-trinitroperhydro-1,3,5-triazine, which may also be known by the variants RDX; cyclonite; hexogen; T4; hexahydro-1,3,5-trinitro-1,3,5 triazine; 1,3,5-trinitro-1,3,5-triazacyclohexane and cyclotrimethylenetrinitramine.

The explosive charge 30 may also comprise a plastic or putty explosive, which is hand malleable, such as composition 4, or C4, which includes approximately 91% 1,3,5-trinitroperhydro-1,3,5-triazine; 6% plasticizer (e.g. diethylhexyl or dioctyl sebacate) and 2% plastic binder (e.g. polyisobutylene) by weight.

The explosive charge 30 may also comprise 1,3,5,7-tetranitro-1,3,5,7-tetrazocane, which may also be known by the variants HMX; cyclotetramethylene-tetranitramine; tetrahexamine tetranitramine and octahydro-1,3,5,7-tetranitro-1,3,5,7-tetrazocane.

The explosive charge 30 may also comprise a polymer-bonded explosive, which, in contrast to a plastic explosive, is not hand malleable after curing, such as LX-14, which includes approximately 96% 1,3,5,7-tetranitro-1,3,5,7-tetrazocane and 4% polymer binders (e.g. estane & 5702-F1) by weight.

Casing 32 provides a backer or support structure to explosive device 10 to direct the energy of explosive charge 30. Casing 32 is shown to be cylindrical around outer surface 34 and further comprises inner concave surfaces 36, 38 which form a bowl-like circular recess wall structure around axis of symmetry 22, and provide surfaces to form the shape of explosive charge 30.

Also between liner 12 and casing 32 is a centrally located elongated core plug 40 which is centered on the axis of symmetry 22 and surrounded by explosive charge 30. Core plug 40 and explosive charge 30 are located in and occupy the circular recess formed by casing 32 and the cavity formed between casing 32 and overlying liner 12. Core plug 40 provides surfaces 42, 44 which oppose surfaces 36, 38 of casing 32 to provide a symmetrical annular shape to explosive charge 30. In alternative embodiments, as shown in FIG. 5, core plug 40 can be eliminated.

As shown in FIG. 3, groove 16 and explosive charge 30 are arranged to provide a projection axis or axis of projection 52, which, in the present embodiment, bisects apex angle A equally. As shown, axis of projection 52 is at an angle B relative to axis of symmetry 22. Angle B, which may be referred to as the projectile angle or angle of projection relative to the axis of symmetry 22, is in the range of and all increments between 1 degree to 45 degrees, more particularly in the range of and all increments between 2 degrees to 20 degrees, and even more particularly in the range of and all increments between 5 degrees to 15 degrees.

Figure 4:
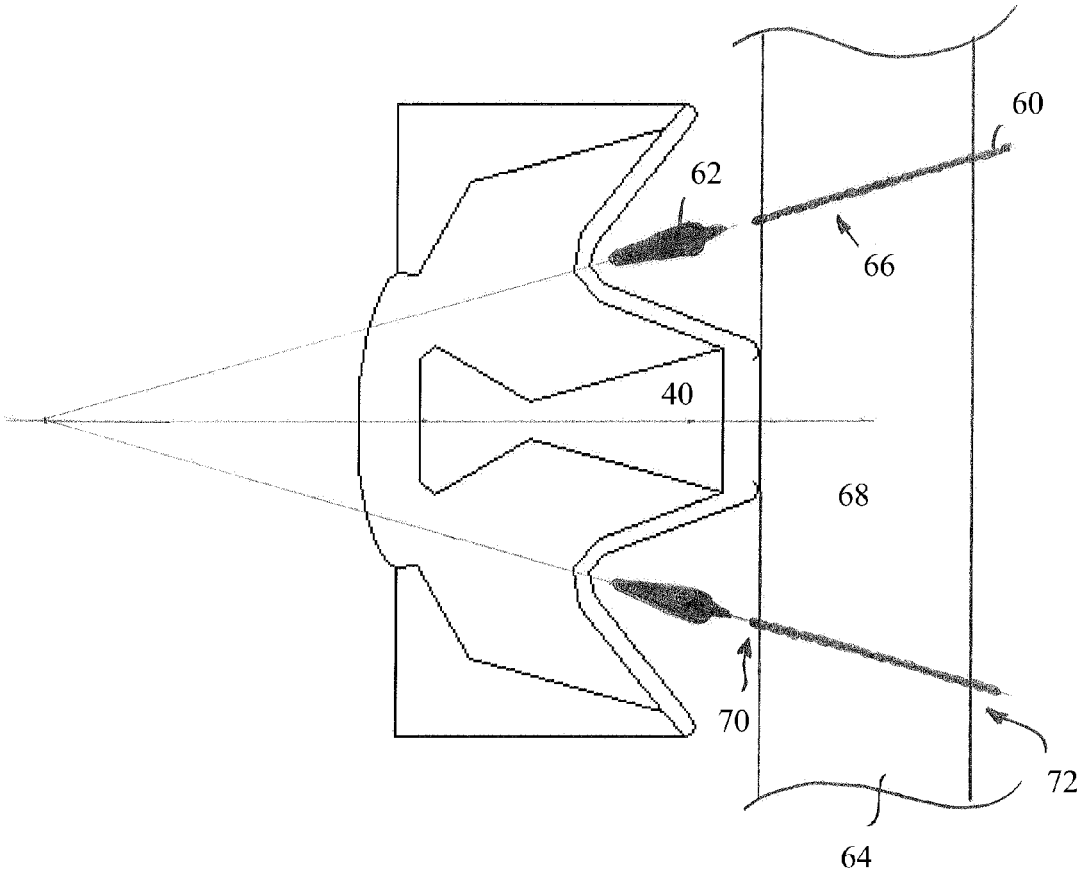
FIG. 4 is a cross-sectional side view of the shaped charge explosive device of FIG. 1 taken along line 2-2 which further shows the formation of a jet ring and slug ring along with the formation of a ring shaped cut pattern in a structure.

When device 10 is detonated, the explosive charge is set off by detonator 50 located to the rear of device 10 on the axis of projection 52 creates a shock wave produced by the detonation front. In various embodiments, detonator 50 may comprise a single detonator, a ring of detonators or an explosive shaped detonation train. As the shock wave progresses from the apex 24 towards the opening of the groove 16, the shock wave compresses the liner 12. As shown in FIG. 4, under the pressure of the shock wave, the liner 12 collapses and protrudes towards the axis of projection 52, which results in the formation of a forward jet ring 60 and slower moving rearward slug ring 62. From the shape of groove 16, the jet ring 60 and the slow moving slug ring 62 form the shape of an enclosed annular ring, which mimics the shape of the groove. Thus, if the shape of the groove 16 is circular or oval, for example, the shape of the jet ring 60 and slug ring 62 may be expected to be circular or oval, respectively.

Once the jet ring 60 and/or slug ring 62 make contact with the desired structure 64, the ring 60, 62 may be configured to cut into the structure 64 to provide a cutting tool in the form of a cutting ring. For example, if the structure 64 comprises a shell (e.g. outer shell of (1) a building, bunker or other fortification, such as a door, side wall, floor or roof thereof; or (2) a vehicle which may travel by land, water or air (e.g. a tank, ship, submarine or airplane) such as armor, a hull or a fuselage thereof; or (3) a weapon or other munition; or (4) any protective enclosure), the jet ring 60 and slug ring 62 may be configured to cut through the wall structure to provide a ring shaped cut pattern 66 therein, as shown in cross-section in FIG. 4. In this manner, the explosive device functions as a hole saw.

The ring shaped cut pattern 66 may provide an aperture in the structure 64. However, in certain instances, the aperture may be at least partially occluded by a resulting obstruction portion 68 of the structure 64 formed and defined by the rings 60, 62 as the cutting is performed.

In the event the ring shaped cut pattern 66 creates an aperture which is occluded by an obstruction portion 68 of the structure 64, within the path defined by the confines of the jet ring 60 or slug ring 62 may be located core plug 40 which may travel at a speed slower than the jet ring 60 and the slug ring 62. Thus after the jet ring 60 and slug ring 62 has formed the ring shaped cut pattern 66, and an obstruction portion 68 of the structure 64 may now exists within the confines of the resulting aperture, the core plug 40 may now impact the obstruction portion 68 and eject it from the aperture. In the even there is no plug 40, the center obstruction 68 may still ne removed by blast over pressure from the explosive 30 detonation.

Now, given that the jet ring 60 and slug ring 62 travel along the angle of projection B relative to the axis of symmetry 22, the ring shaped cut pattern 66 will tend to be in the form a frusto-conical ring shaped cut pattern 66 which enlarges in diameter as it progresses through the structure 64 from a point of entry 70 to a point of exit 72. Thus, any obstruction 68 in the aperture may also take on a frusto-conical shape. Given that the fact that the frusto-conical shape of the obstruction will enlarge from the point of entry 70 to point of exit 72 of the jet ring 60 and slug ring 62, it may be easier for the core plug 40 to eject or remove the obstruction 68 from the structure 64 than if the ring shaped cut pattern 66 were simply cylindrical, which may be expected to occur if the angle of projection B of the explosively formed projectile was parallel with the axis of symmetry 22.

In an alternative embodiment, as shown in the cross-sectional view of FIG. 5, explosive device 10 may have a polygonal shape, and in particular polygonal liner 12, polygonal groove 16, polygonal explosive charge 30 and polygonal casing 32. More specifically, as shown in FIG. 5, the polygonal shape is an octagon. In other embodiments, the polygonal shape may be a trigon, tetragon (square), pentagon, hexagon, heptagon, nonagon, decagon, hendecagon or dodecagon. In contrast to the preceding embodiment, the explosive device 10 of FIG. 5 will create a polygonal annular ring (as opposed to a circular annular ring), and have a cut pattern which is a polygonal pyramid (as opposed to conical), with the number of sides corresponding to the number of sides of the explosive device 10.

Figure 6:
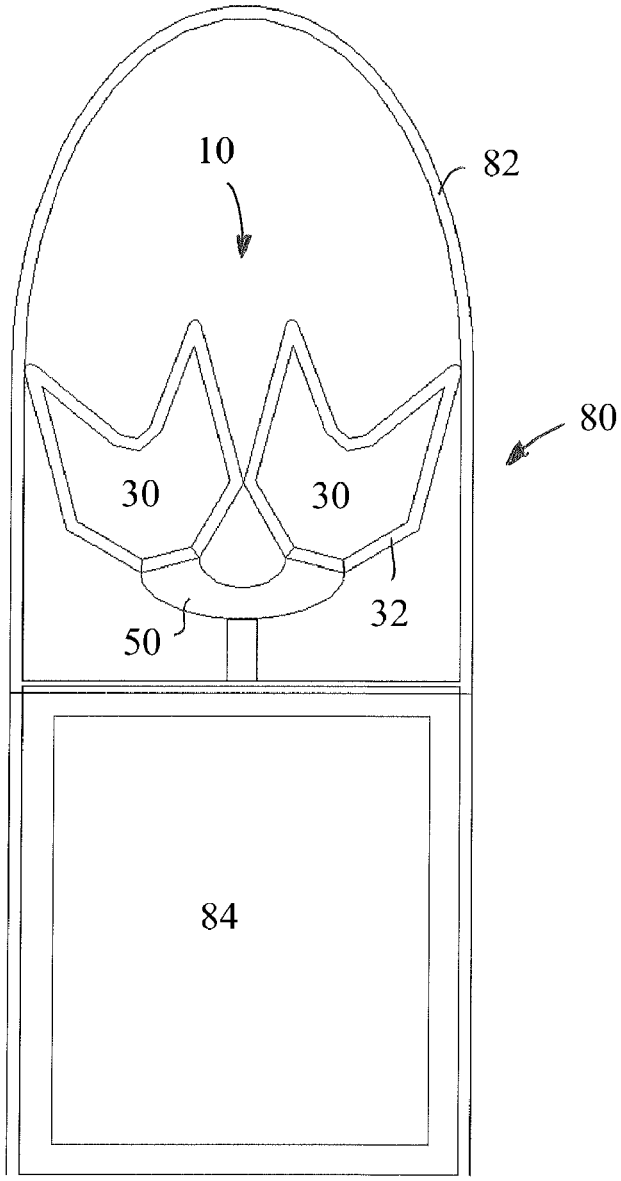
FIG. 6 is a side view of another embodiment of the shaped charge explosive device in a warhead of a self-propelled bomb.

As shown in FIG. 6, the explosive device 10 may be utilized as a warhead in a missile, rocket, torpedo or other self-propelled bomb 80 having an aerodynamic cover or nose cone 82. In other embodiments, explosive 10 may be used as a static (stationary) device and not as part of a self-propelled bomb. As also shown in FIG. 6, casing 32 may comprise a tubular channel.

Also as shown in FIG. 6, self-propelled bomb 80 may include a secondary device 84, which may comprise another explosive charge configured to detonate after the charge 30 has detonated, or a sensing device, such as a device capable of sensing a weapon of mass destruction, such as a nuclear weapon.

The shaped charges disclosed herein may be used in various types of military ordnance, such as weapons and munitions including warheads (explosive material and detonator delivered by rocket, missile, torpedo or other self-propelled bomb), gun-fired projectiles and mines. The shaped charges may also be used breeching devices to breach a structure, such as provide an opening to gain entry to the structure or to weaken the structure (e.g. demolition of a building). The shaped charges may also be used an initial breech device for a secondary device (e.g. tandem warhead).

While a preferred embodiment of the present invention has been described, it should be understood that various changes, adaptations and modifications can be made therein without departing from the spirit of the invention and the scope of the appended claims.

The scope of the invention should, therefore, be determined not with reference to the above description, but instead should be determined with reference to the appended claims along with their full scope of equivalents. Furthermore, it should be understood that the appended claims do not necessarily comprise the broadest scope of the invention which the Applicant is entitled to claim, or the only manner(s) in which the invention may be claimed, or that all recited features are necessary.

What is claimed:

1. A shaped charge device having a front, a rear and an axis of symmetry, the device comprising:

an explosive charge;

a liner lining a front of the explosive charge, the liner having a recess in the form of a groove encircling the axis of symmetry; and the groove arranged to provide an axis of projection for the liner at an angle relative to the axis of symmetry, wherein the angle is in the range of 1 degree to 45 degrees; and a core plug; and wherein the explosive charge arranged to form the liner into a jet ring upon detonation of the shaped charge device to form a ring shaped cut pattern in a structure contacted by the jet ring, and, after the jet ring has formed the ring shaped cut pattern, impact a portion of the structure within the ring shaped cut pattern with the core plug.

2. The device of claim 1 wherein:

the axis of projection diverges along the axis of symmetry from the rear of the device towards the front of the device.

3. The device of claim 1 wherein:

the groove has an apex angle; and the apex angle is in the range of 20 degrees to 140 degrees.

4. The device of claim 1 wherein:

the groove is V-shaped.

5. The device of claim 1 wherein:

the groove is circular.

6. The device of claim 1 wherein:

the groove is polygonal.

7. The device of claim 1 wherein:

the groove is defined by an outer wall portion of the liner and an inner wall portion of the liner relative to the axis of symmetry;

the outer wall portion converges along the axis of symmetry from the front of the device towards the rear of the device; and the inner wall portion diverges along the axis of symmetry from the front of the device towards the rear of the device.

8. The device of claim 7 wherein:

the outer wall portion is frusto-conical; and the inner wall portion is frusto-conical.

9. The device of claim 7 wherein:

the outer wall portion is planar; and the inner wall portion is planar.

10. The device of claim 1 wherein:

the liner has a circular periphery; and the groove extends to the circular periphery of the liner.

11. The device of claim 1 wherein:

the liner has a polygonal periphery; and the groove extends to the polygonal periphery of the liner.

12. The device of claim 1 wherein:

the liner comprises metal.

13. The device of claim 1 wherein:

the explosive charge is arranged to form the liner into a formed projectile in the shape of an annular ring upon a detonation thereof.

14. The device of claim 13 wherein:

the annular ring is circular.

15. The device of claim 1 wherein:

the annular ring is polygonal.

16. The device of claim 1 wherein:

the explosive charge comprises an organic nitrate explosive.

17. The device of claim 1 further comprising:

the core plug provides at least one surface which opposes a surface of an outer casing to provide a symmetrical annular shape to the explosive charge.

18. The device of claim 1 wherein:

the core plug is encircled by the explosive charge.

19. The device of claim 18 wherein:

the core plug is covered by a disc shaped portion of the liner.

20. The device of claim 1 further comprising:

a detonator located to a rear of the explosive charge.

21. The device of claim 1 further comprising:

a casing located to a rear of the explosive charge.

22. The device of claim 21 wherein:

the casing is circular.

23. The device of claim 21 wherein:

the casing is polygonal.

24. The device of claim 21 wherein:

the casing and liner form an enclosed tubular channel.

* * * * *